US005134945A

United States Patent [19]

Reimlinger et al.

[11] Patent Number: 5,134,945

[45] Date of Patent: Aug. 4, 1992

[54] REGENERATIVE THERMAL OXIDIZER WITH GATE MANIFOLD SYSTEM

[76] Inventors: Richard G. Reimlinger, 24 Hunter Ave., Fanwood, N.J. 07023; James L. Nester, 2-12 Wyncoop Ct., Holland, Pa. 18966

[21] Appl. No.: 817,527

[22] Filed: Jan. 6, 1992

[51] Int. Cl.[5] ..... F23G 5/46; F23G 7/06; F27D 17/00; F28D 17/04

[52] U.S. Cl. ..... 110/304; 165/4; 137/309; 432/180; 432/181

[58] Field of Search ..... 165/4; 137/309; 432/180, 181; 110/304

[56] References Cited

U.S. PATENT DOCUMENTS

| | | | |
|---|---|---|---|
| 1,811,455 | 6/1931 | Cook | 165/4 |
| 3,184,223 | 5/1965 | Webber | 137/309 |
| 3,225,819 | 12/1965 | Stevens . | |
| 3,368,327 | 2/1968 | Munters et al. | 165/4 |
| 3,741,286 | 6/1973 | Muhlrad . | |
| 4,280,416 | 7/1981 | Edgerton | 165/4 |
| 4,398,590 | 8/1983 | Levoy | 165/4 |
| 4,470,806 | 9/1984 | Greco | 432/182 |
| 4,754,806 | 7/1988 | Astle, Jr. . | |
| 4,793,974 | 12/1988 | Hebrawk | 165/4 |
| 4,966,228 | 10/1990 | Fawcett . | |
| 5,026,277 | 6/1991 | York | 432/181 |

*Primary Examiner*—Albert W. Davis, Jr.
*Attorney, Agent, or Firm*—Kenneth P. Glynn

[57] ABSTRACT

The present invention is directed to a regenerative thermal oxidizer apparatus and a method for purifying gases by thermal oxidation and by exchange of heat by inleting and outleting gases. The oxidizer has at least three regenerative thermal chamber units and these units have on a single surface both an inlet opening and an outlet opening which are typically connected to inlet and outlet gases. Set against the inlet and outlet openings is a slidable gate which has a single opening which moves through cycles so that its single opening coincides with the inlet opening of its chamber unit, or a space which is closed between the inlet and outlet opening, or coincide with the outlet opening. In other words, the gate cycles between inleting gases, no gas movement, and outleting gases. There are means providing for moving the gate through the aforesaid cycle and, as mentioned, inlet ducts and outlet ducts connected to their respective openings. The method involves utilizing the aforesaid apparatus so as to purify gases by incineration and to cuase heat exchange by first running inlet gases through a given chamber unit and outlet gases through another chamber unit and reversing the flow between units as well as switching units for inlet and outlet purposes.

24 Claims, 4 Drawing Sheets

REGENERATIVE THERMAL OXIDIZER WITH GATE MANIFOLD SYSTEM

BACKGROUND OF THE INVENTION

1. Field of the Invention

The present invention is directed to a method and apparatus for regenerative thermal oxidation. More specifically, it is a method and a thermal oxidizer for purifying gases by incineration while providing regenerative heat exchange between inleting and outleting gases. Such systems are used in commercial and industrial operations for removal of air pollutants from gases which would otherwise be released to the atmosphere. By thermal oxidation, these gases are raised to their auto ignition temperature, creating safer, and more simple exhaust gas compounds. By using proper heat exchange techniques, as described herein, the efficiency in the cost of operation is enhanced. Thus, the present invention, a regenerative thermal oxidizer apparatus and process utilizes a unique gate manifolding system for the control of airflow into and out of the thermal oxidizer.

2. Prior Art Statement

Regenerative thermal oxidizers such as in the present invention, utilize a back flow of gases through the heat exchanger to maximize the recapture of heat which might otherwise be lost to the atmosphere. These systems include minimally a combustion chamber which receives the preheated gas, and recovery chamber which cools the gas exiting so as to reclaim most of the heat to be applied to the inleting process gas before entering the combustion chamber. A burner is used to maintain temperature in the combustion chamber. Typically the system operates dynamically holding inlet and outlet conditions for a predetermined period of time before continuing on to the next inlet/outlet condition. In this manner, the regenerator could become one of a heating regenerator rather than an exhaust regenerator and the portion or unit which constituted the heating regenerator could become the cooling regenerator. Early regenerator systems involved the use of, for example, two chambers wherein the gases to be purified entered into the bottom of one chamber, rose up therethrough for oxidation, and back down through and out a second chamber unit for capture of the heat. Operated in this manner, for a period of time, the process was reversed so that the inlet gas is now moved first into what was the exhaust chamber utilizing the energy for preheat. One of the problems which existed during the flow reversal involved large pressure swings which create back pressure effecting manufacturing systems which require equilibrium within the system. Oxidizers with three or more chambers can make use of an idle chamber which transitions with one or more of the other chambers to maintain an even flow across the systems during changes in airflow direction through the equipment. Difficulties arose with respect to the manifolding of these gases because, historically, flap valves which rotated were utilized to provide the inleting and outleting of the process exhaust gases. This caused inefficiencies, improper sealing problems, mechanical wear and tear due to the rotational aspects thermal expansion problems, and pockets of process air which would not be treated after the flap valves transitioned from inlet to outlet positions. In addition, flap valves require a complicated array of control to insure each valve is opening and closing properly. In fact prior art makes no provision for allowing both inlet and outlet flap valves from opening and closing simultaneously, allowing contaminated air to bypass the oxidation chamber and be exhausted, unprocessed, to the atmosphere.

Various solutions have been developed to address problems incurred in regenerative heat chambers, although the prior art does not teach or suggest the present invention described herein. The following patents are representative of the state of the art:

U.S. Pat. No. 3,741,286 issued to Wolf Muhlrad described a regenerative heat exchanger and method for purging its flow passages. The invention described involves double chambers with gases passing up one side and down the other and then reversing. This is accomplished by rotation of a series of dampers which do not eliminate the above mentioned problems with rotational valves.

U.S. Pat. No. 4,470,806 issued to Richard Greco described regenerative incinerators utilizing a series of heat exchanger chambers with perforated horizontal support grates with combustion chambers located above heat exchangers and utilizes openings and closings of various lines to achieve reversals for heat exchange. However, as in the other prior art, this patent utilizes valves which rotate to open and close the inlet and outlet manifolds.

U.S. Pat. No. 3,225,819 issued to E.S. Stevens describes an apparatus and method for air-to-air heat exchange, but again, utilizes rotational valving.

U.S. Pat. No. 4,754,806 describes a reciprocating heat exchanger and utilizes a porous metal element for absorbing heat for the exhaust air stream and also describes movement of this porous metal element from one side to another so as to effectively exchange heat by receiving heat from exiting gases and moving it over to inlet gas lines. However, this patent does not describe valving or manifolding and takes a totally different approach by never reversing the flow of gases but only reciprocally relocating heat absorbing elements.

Most recently issued U.S. Pat. No. 4,966,228 and U.S. Pat. No. 5,026,277, seem to describe the present state of the art in this field. The latter patent to James York describes a regenerative thermal incinerator apparatus utilizing a system of valved duct work to direct gases to various combustion chambers and to idle a third regenerator for purging of partially treated gas so as to recycle it back through the system and so as to, thereby, reduce or eliminate lost gases which have not been properly purified. U.S. Pat. No. 4,280,416 issued to Phillip Edgerton, describes a rotary valve for regenerative thermal reactors. While this patent describes valves which rotate instead of swing or rotate about an axis parallel to the valve surface, it still requires rotation of a valve about an axis at right angles to its surface and rotational friction and mechanical drive is necessitated. U.S. Pat. No. 4,966,228 issued to Sherwood Fawcett describes a regenerative gas-to-gas heat exchanger requiring a special geometry for a chamber and utilizing gate valves to direct or redirect gases through different chambers. Unlike the present invention, however, Fawcett does not reverse gas flow and Fawcett does not rely upon the use of sliding gates having an orifice which is moved from an inlet to dead space or closed off space to an outlet and recycled back and forth so as to control the flow of gases in one direction and then in the exact opposite direction within a specific chamber unit.

Fawcett neither uses the structure nor achieves the same or similar results of the present invention.

SUMMARY OF THE INVENTION

The present invention is directed to a regenerative thermal oxidizer and a method for purifying gases by raising gases to their auto ignition temperature and by exchanging heat by inleting and outleting gases. The reactor has at least three regenerative thermal chamber units and these units have on a single surface both an inlet opening and an outlet opening which are typically connected to inlet and outlet gases. Set against the inlet and outlet openings is a slidable gate which has a single opening which moves through cycles so that its single opening coincides with the inlet opening of its chamber unit, or a space which is closed between the inlet and outlet opening, or coincide with the outlet opening. In other words, the gate cycles between inleting gases, no gas movement, and outleting gases. There are means providing for moving the gate through the aforesaid cycle and, as mentioned, inlet ducts and outlet ducts connected to their respective openings. The method involves utilizing the aforesaid apparatus so as to purify gases by thermal oxidation and to cause heat exchange by first running inlet gases through a given chamber unit and outlet gases through another chamber unit and reversing the flow between units as well as switching units for inlet and outlet purposes.

BRIEF DESCRIPTION OF THE DRAWINGS

The present invention will be more fully understood when the specification herein is taken in conjunction with the appended drawings. These drawings illustrate the following.

DETAILED DESCRIPTION OF THE INVENTION

The present invention is directed to eliminating rotation or revolution of valve mechanisms in regenerative thermal oxidation units. Thus, it is an objective of the present invention to provide gates which neither rotate nor revolve but merely slide back and forth. This can be accomplished with vertical or horizontal or otherwise positioned gates without exceeding the scope of the present invention.

It is also an object of the present invention to eliminate or substantially reduce problems typical of the rotational valves, sealing problems and heat loss problems resulting from such inefficiencies, thereby substantially increasing the efficiencies of the system.

It is an object of the present invention to also provide a new, reliable, different and more cost effective mechanism for reversing gas flow in chamber units for regenerative thermal oxidation systems.

It is also an object of the present invention to permit chambers to be shutdown for purposes of purging or otherwise or to operate on a cycle with continual switching and reversing of chambers and gas flow direction.

Figure 1:
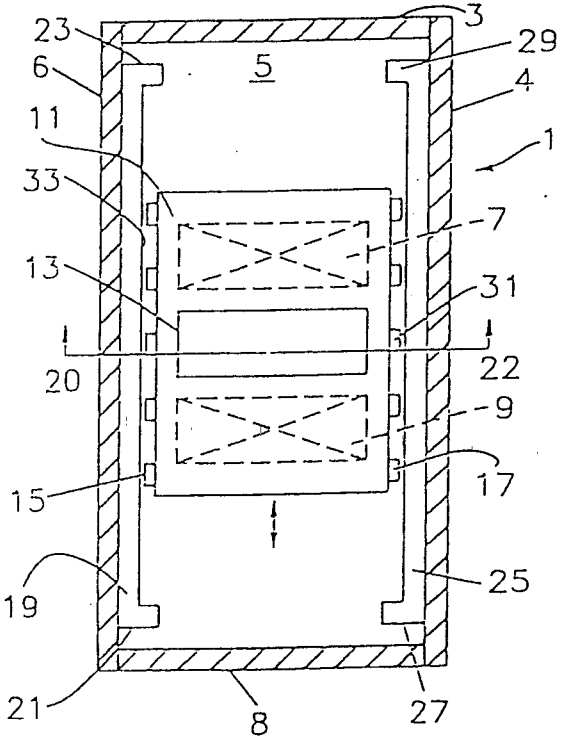
FIG. 1 is a cut top view of a single chamber unit of a regenerative thermal oxidizer for the present invention.

FIG. 1 shows a top cut view of a single regenerative thermal chamber unit 1 of a present invention multi-unit reactor apparatus. This unit 1, has a lower receiving chamber and an upper combustion chamber such as is discussed in conjunction with FIGS. 4 and 5 below.

Unit 1 has walls 3, 4, 6 and 8 and a base surface 5. In this embodiment, the base surface 5 is a bottom surface, but it could be otherwise, e.g. a side surface. Base surface 5 includes a gas inlet opening 7 and a gas outlet opening 9. Here, openings 7 and 9 are rectangular, but they could be of any configuration, such as a square or a round orifice. They are separated or spaced apart by a distance, which is at least equal to the width of a gate orifice 13. Gate 11 movably rests atop and against base surface 5 and contains gate orifice 13, as shown.

Gate 11 moves through cycles with three critical positions for advanced manifolding of unit 1. One critical position occurs when gate orifice 13 seats against gas inlet opening 7. In this position, gas outlet opening 9 is closed and only inlet gases enter chamber unit 1. A second critical position is when gate orifice 13 rests against base surface 5 at an area between openings 7 and 9. This is as shown in FIG. 1 and in this position, both inlet opening 7 and outlet opening 9 are closed. In a third critical position gate orifice 13 is seated against outlet opening 9 and gases only exit the chamber unit 1.

Figure 2:
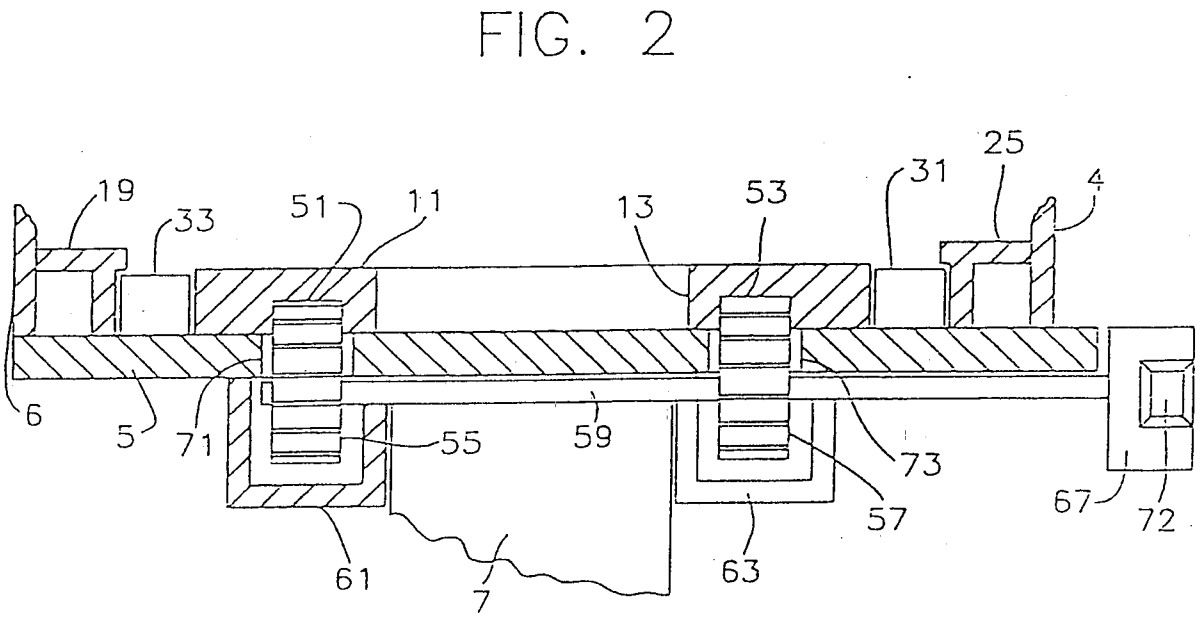
FIG. 2 shows a cut end view of a portion of the chamber unit shown in FIG. 1.

FIG. 2 shows an end cut view of the chamber unit 1 of FIG. 1 along line AB.

Referring now to both FIGS. 1 and 2 taken together, and in which identical components are identically numbered, gate 11 includes roller wheels 15, 17, 31 and 33 (typical). Guide brackets 19 and 25 are also shown and include ends 21,23, 27 and 29. While guide brackets and wheels are shown in this embodiment, other guide means could be used or none could be employed if the gate where sized or seated or if the gate relied upon gravity, e.g. was on pulleys on a side wall. In fact, any known arrangement for maintaining a slide plate or gate in position for opening and closing may be used.

Gate 11 has cut outs 51 and 53 on its underside and these mesh with gears 53 and 57, which pass through gear openings 71 and 73 in base surface 5. Gears 53 and 57 are connected to axle 59, which is driven by motor 67 and controlled by computer 72. The control involves movement of gate 11 from one end of the brackets 19 and 25 to the other end and back again, completing a cycle. The gate 11 may be stopped for a preset time at each of its three critical positions mentioned above or continuously move during the cycle. The controls may be by electric timers, mechanical cycling wheels, hydraulics, pneumatics, computer, a combination of these or otherwise.

The chamber unit 1 is employed in a present invention thermal oxidizer having at least two other chamber units. The controls are employed so that respective gates are out of phase with one another in their respective critical positions. In one preferred embodiment, the respective gates are 120° out of phase. In cases where, for example, four chambers are utilized, and two are typically closed at any one time, they may be 90° out of phase or multiple of 90°, or 225° out of phase or otherwise, as may now be within the purview of the artisan.

A typical three unit reactor will have cycles in which the gates will move sequentially so that when in critical positions, will always have two inlets closed, two outlets closed, one outlet from a chamber open and one inlet from another chamber open. (These would double in number for a six chamber reactor.) The various combinations for a three unit reactor with one typical sequence is illustrated in Table 1, below.

TABLE 1

EXAMPLE OF SIX PHASE CYCLE

| Phase | Line | Unit 1 | Unit 2 | Unit 3 |
|---|---|---|---|---|
| 1st phase | Inlet | Open | Closed | Closed |
| | Outlet | Closed | Closed | Open |
| 2nd phase | Inlet | Open | Closed | Closed |
| | Outlet | Closed | Open | Closed |
| 3rd phase | Inlet | Closed | Closed | Open |
| | Outlet | Closed | Open | Closed |
| 4th phase | Inlet | Closed | Closed | Open |
| | Outlet | Open | Closed | Closed |
| 5th phase | Inlet | Closed | Open | Closed |
| | Outlet | Open | Closed | Closed |
| 6th phase | Inlet | Closed | Open | Closed |
| | Outlet | Closed | Closed | Open |

As can be appreciated, the sequences shown above in Table 1 could readily be altered, reversed, etc., and yet still achieve the advantageous manifolding of the present invention.

Figure 3:
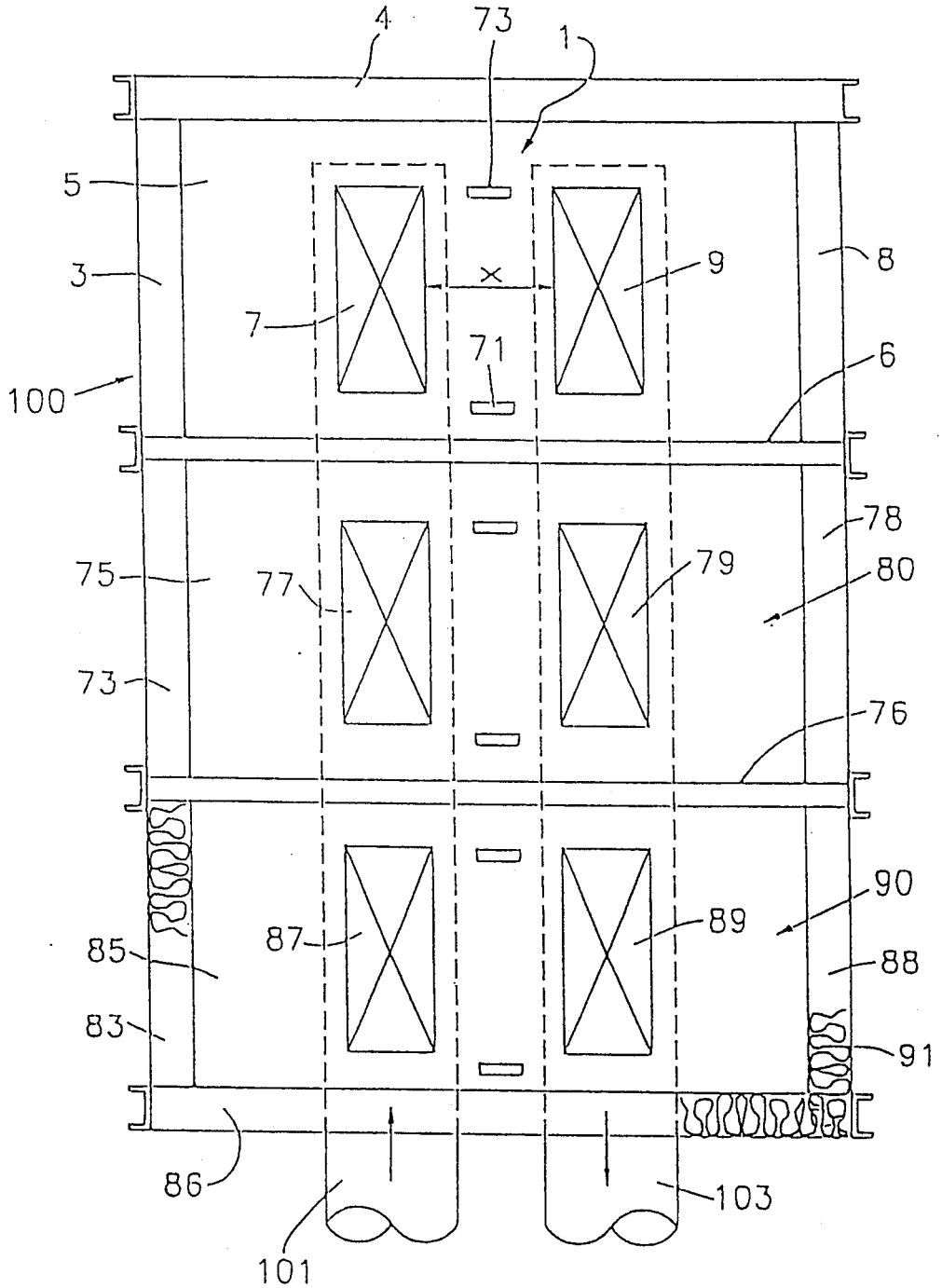
FIG. 3 shows a top view of three chamber units utilized in the present invention including the FIG. 1 chamber unit but without the gates shown and the drive gear ports shown so as to simplify the view to illustrate the inlet and outlet openings of a typical oxidizer of the present invention.

FIG. 3 shows a top opened view of a three chamber unit oxidizer of the present invention. Oxidizer 100 includes chamber unit 1 shown in FIGS. 1 and 2 but the chamber units here have the gates, rollers, guides, etc. removed to illustrate inlet and outlet connections. With respect to chamber unit 1, components identical to those of FIGS. 1 and 2 are identically numbered. Chamber units 80 and 90 have walls 73, 78, 83 and 88 as shown, and common wall 76 and end wall 86. The common walls 6 and 76 do not extend completely to the top of the reactor and an open flow area (shown in conjunction with other embodiments below) is not shown. Unit 80 includes inlet opening 77 and outlet opening 79, located on base surface 75. Unit 90 includes inlet opening 87 and outlet opening 89 on base surface 85.

Main gas inlet conduit 101 is connected to inlet openings 7, 77 and 87 and purified gas outlet conduit 103 is connected to outlet openings 9, 79 and 89. Incoming gases containing undesirable components to be thermally oxidized enter one or two chambers via main inlet conduit 101 and exit through one or two chambers (where the inlet openings are not open) and then through outlet conduit 103. The gates (not shown) may be 120° out of cycle and operate consistent with the sequences shown in Table 1 above. By this method, the same volumetric flow of inlet and outlet gases continuously pass through the chamber units for an efficient operation. In fact, when one gate opens and another gate closes an inlet or outlet, they may be precisely timed so that the total open area of the one opening and the other closing equals a single, fully opened inlet orifice.

Figure 4:
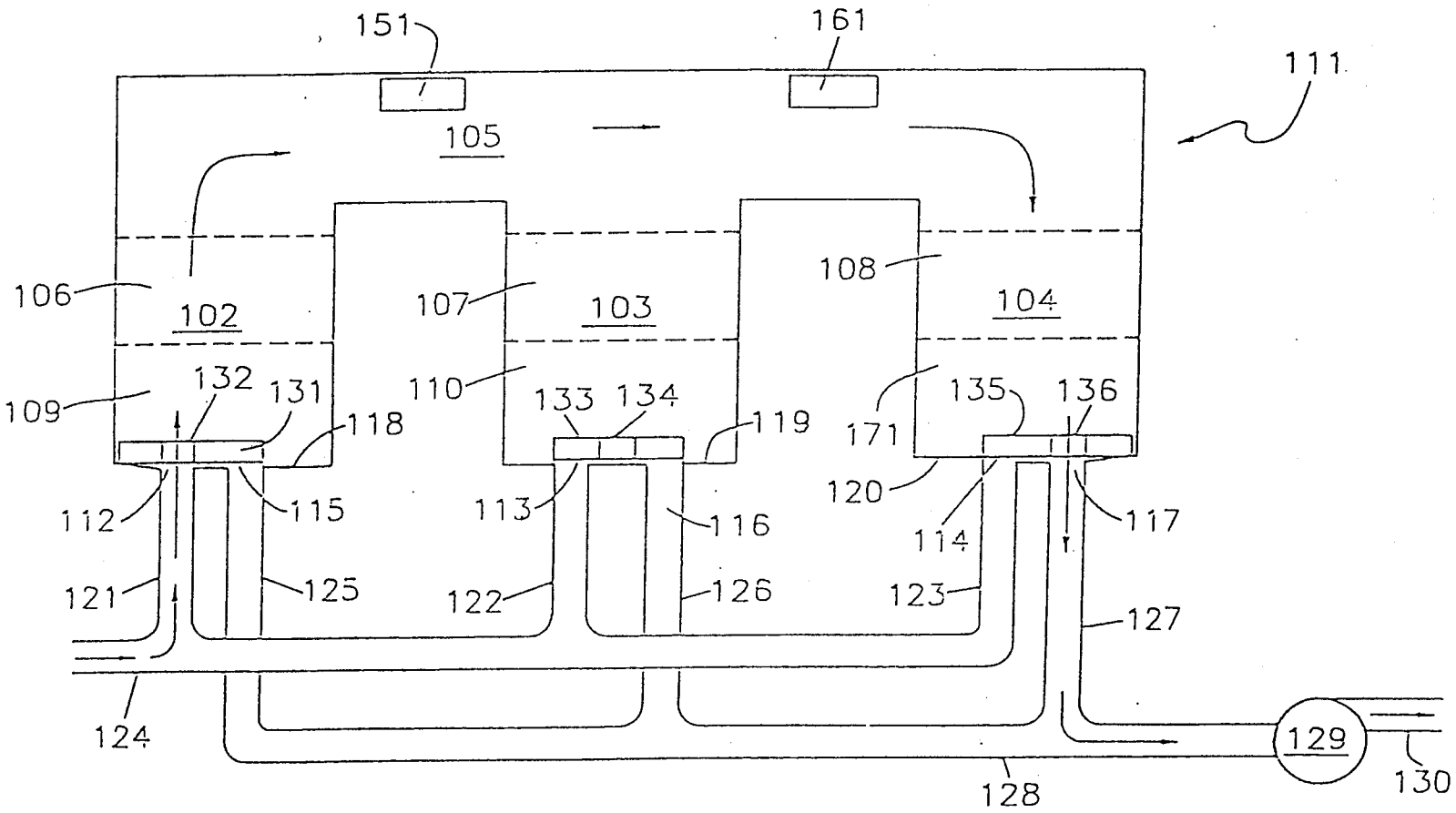
FIG. 4 shows a side cut diagrammatic view of a simplified arrangement for three chamber units of a present invention thermal oxidizer utilizing horizontal gates; and, FIG. 5 likewise shows a simplified diagrammatic side view of a present invention oxidizer but utilizing vertical gates.

FIG. 4 shows a front schematic diagram of an alternative thermal oxidizer embodiment of the present invention. Here, oxidizer 111 includes chamber units 102, 103 and 104 as shown. A common flow path at the top of these chambers is shown as connecting section 105. Additionally, each of the chamber units has combustion chamber sections 106, 107 and 108 respectively and recovery chambers 109, 110 and 171, respectively. These are shown as being divided by dotted lines in this schematic. However, these chambers may contain conventional heat exchange devices such as rakes or grids, heat exchange saddles, or any other known heat exchange materials which are utilized in the thermal oxidation systems. Additionally, any conventional firing mechanisms may be used and are not points of criticality with respect to this invention. Burners 151 and 161 are located as shown, for example.

At the bottom surface 118 of chamber unit 102 is inlet opening 112 and outlet opening 115. Likewise, in chamber units 103 and 104 respectively there are base surfaces 119 and 120 with inlet openings 113 and 114 and outlet openings 116 and 117. Gases to be purified flow in general through main duct 124 and may flow into chamber units 102, 103 or 104 via inlet lines 121, 122 and 123 as shown. Likewise, purified gases which have been thermally oxidized may exit through exit lines 125, 126 or 127 for chamber units 102, 103 and 104. These join at main outlet line 128 and are exhausted to exhaust line 130 via impeller 129.

Chamber unit 102 includes a gate 131 with gate orifice 132 as shown. Not shown in this schematic with respect to any of the chamber units is a mechanism for moving the gate left to right. However, such a mechanism may be that which is shown in FIGS. 1 and 2, or it may be by pulley or chain or a push-rod or other mechanism such as is described herein. In any event, chamber units 103 and 104 includes gates 133 and 135 with gate orifices 134 and 136. In FIG. 4, the gates 131, 133 and 135 are cycling at 120° out of phase. Therefore, in this "freeze frame" schematic diagram, gate 131 is left most with gate orifice 132 being superimposed over inlet opening 112. In chamber unit 103, gate 133 is centrally located and gate orifice 134 is over neither inlet 113 nor outlet 116 and therefore there is no gas movement into or out of chamber unit 103. Chamber unit 104 has its gate 135 in a right most position with gate orifice 136 superimposed over gas outlet opening 117. Thus, as shown by the arrows, inlet gases enter through chamber unit 102 and are combusted through section 105 and down through chamber unit 104 where heat is recovered and the gases exit via line 128 and exhaust 130.

Taking into consideration FIGS. 1, 2 and 4, it can be seen that the dynamics of reactor 111 are similar to that described in conjunction with the above drawings, and, for example, as gate 131 shifts to the right, gate 133 and chamber unit 103 would shift to the left so that the combined volume of gases entering chamber unit 102 and chamber unit 103 would be a constant. Eventually, gate 133 which shifts all the way to the left and gate 131 would be in the middle shutting off any flow in either direction in chamber unit 102. The sequence would continue similar to that shown in Table 1 described above.

As mentioned, the present invention includes three or more chamber units and it can be seen that rather than just one chamber unit being shut off at a given time, a plurality of chamber units could be shut off at a single time. Likewise, it is possible to work with five chambers whereby two chambers are inleting gases and two chambers outleting gases with a shifting of one chamber at a time. Further, with six chamber units, two could be open, for example, with inlet gases flowing in, two could be closed and two could be open for outlet gases flowing out and the sequences would be identical to the system just described except that double the number of chambers would be in use at any given time.

Figure 5:
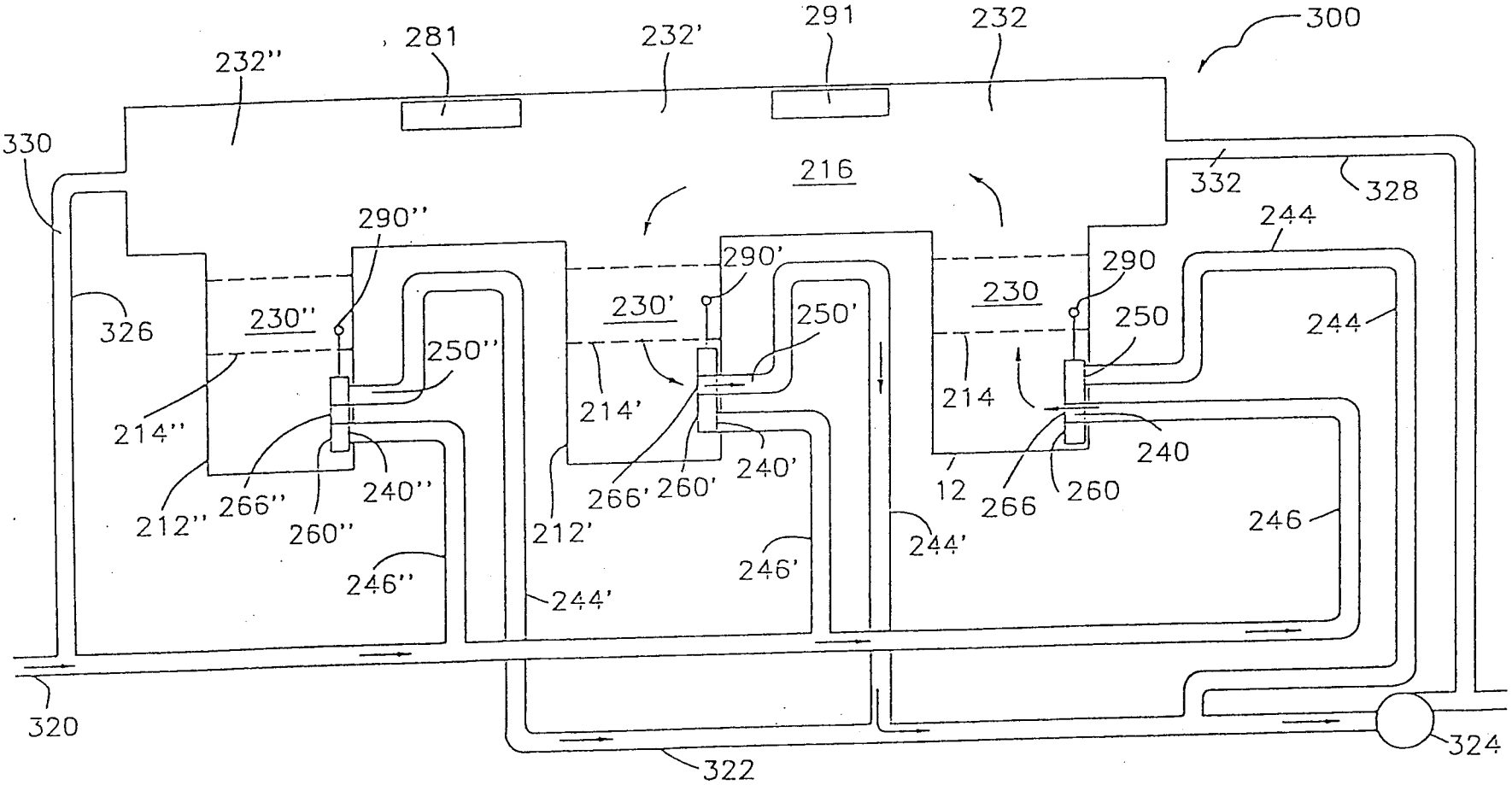

FIG. 5 shows another schematic diagram of yet another alternative regenerative thermal oxidizer 300. Chamber units 230, 230' and 230" are located as shown with a common section 216 representing the upper most portions 232, 232' and 232" for each of the chamber units respectively. Likewise, recovery chambers and thermal oxidation chambers are included in each chamber unit and are numbered as 214, 214' and 214", as well as 212, 212' and 212" respectively. Burners 281 and 291 are also included between units, as shown.

Oxidizer 300 differs from the other reactors above in a number of fashions. For example, extra lines are included to permit purging and recycling of exhaust air to replace dirty process air and continue back into the inlet cycle of the system. Also, the gates are located in a vertical plane rather than a horizontal plane. Further, the gate mechanisms are predominately motor driven chain and pulley systems but not limited thereto. Thus, referring now to chamber unit 230 but understanding that identical considerations and arrangements are set-up for chamber units 230' and 230", chamber unit 230 includes inlet opening 240 and outlet opening 250. Gate 260 includes gate orifice 266. The gate is raised and lowered by a motor (not shown) and chain and pulley mechanism 290. FIG. 5 shows gate 260 in the fully down position, gate 260' in the fully up position and gate 260" in the middle position. This results in inlet gases, outlet gases and no gas movement respectively for each of the chamber units 230, 230' and 230". In normal use, gases inlet through line 320 and up through inlet duct 246 and outlet through line 322 with impeller 324. Typically, outlet gases flow through duct work 244 and combine with line 322. In the "freeze frame" representation of FIG. 5, gases are inleting into chamber unit 230 and outleting through 230'. Obviously, it should now be seen that the gases could enter and exit any one of the chambers depending upon the locations of the gates. Through the use of auxiliary line 326 and valve 330 and auxiliary line 328 and valve 332, it is possible to open these lines to remove gases from a given chamber which have not been fired and recycle them into a subsequent chamber or to take gases which have not been purified and blow them into a chamber to exhaust gases either through the main exhaust or through a recycling loop, as shown. This is known as purging and may typically be accomplished in a chamber which has been shut-down or by-passed so that, when it is started up, initially, gases which are not completely purified, are recycled back to the system. This increases the efficiency and decreases the likelihood of spent gases not being completely purified.

Other variations should now be seen obvious to the artisan in view of the detailed description and the appended drawings. For example, the base surface of the present invention reactor and gate need not be flat. The base surface and the gate could be arcuated and operate without exceeding the scope of invention. This would be the case utilizing a vertical gate within a circular chamber unit. Further, the above representations are presented to be merely illustrative and the scope of the present invention should not be construed to be strictly limited to the particular examples set forth above.

Obviously, numerous modifications and variations of the present invention are possible in light of the above teachings. It is therefore understood that within the scope of the appended claims, the invention may be practiced otherwise than as specifically described herein.

What is claimed is:

1. A regenerative thermal oxidation apparatus for purifying gases by thermal oxidation and for exchange of heat between inleting and outleting gases, which comprises:

(a) an oxidizer having at least a first regenerative thermal chamber unit, a second such unit and a third such unit;

(b) each of the aforesaid regenerative thermal chamber units having at least an inlet opening and an outlet opening located on a single base surface and being spaced apart a distance equal to or more than the width of a gate orifice described below;

(c) each of the aforesaid regenerative thermal chamber units further having a gate with at least one gate orifice and being movably located in a linear fashion against said base surface so as to have a first position, a second position and a third position against said base surface, said first position being with direct alignment of said gate orifice with the inlet opening, said second position being with said gate orifice located between the inlet opening and the outlet opening, and said third position being with direct alignment of said gate orifice with the outlet opening;

(d) means for moving the gate for each of the aforesaid regenerative thermal chamber units through a cycle which includes forward movement through a said first position, said second position and said third position and reverse movement back through said second and first positions; and, (e) inlet ducts connected to said inlet openings and outlet ducts connected to said outlet openings.

2. The thermal oxidizer apparatus of claim 1 wherein, each of said regenerative thermal chamber units has a thermal reaction section and a heat recovery section.

3. The thermal oxidizer apparatus of claim 1 which further includes means for controlling the movement of each of said gates relative to one another so as to coordinate gate movement to create equal volumes of inlet gases and outlet gases during operation of said apparatus.

4. The thermal oxidizer apparatus of claim 3 wherein, said means for controlling said movement is electromechanical.

5. The thermal oxidizer apparatus of claim 3 wherein, said means for controlling said movement includes preprogrammed computer control.

6. The thermal oxidizer apparatus of claim 3 wherein, said means for controlling said movement is hydraulic.

7. The thermal oxidizer apparatus of claim 3 wherein, said means for controlling said movement is pneumatic.

8. The thermal oxidizer apparatus of claim 1 wherein, said means for moving the gates includes an electric motor driven system.

9. The thermal oxidizer apparatus of claim 8 wherein, aid means includes motor driven gear drives.

10. A thermal oxidizer apparatus for purifying gases by incineration and for exchange of heat between inleting and outleting gases, which comprises:

(a) an oxidizer having a plurality of regenerative thermal chamber units equal to or greater than three such units;

(b) each of the aforesaid regenerative thermal chamber units having at least an inlet opening and an outlet opening located on a single base surface and being spaced apart a distance equal to or more than the width of a gate orifice described below;

(c) each of the aforesaid regenerative thermal chamber units further having a gate with at least one gate orifice and being movably located in a reciprocal back and forth fashion against said base surface so as to have a first position, a second position and a third position against said base surface, said first position being with direct alignment of said gate orifice with the inlet opening, said second position being with said gate orifice located between the inlet opening and the outlet opening, and said third position being with direct alignment of said gate orifice with the outlet opening;

(d) means for moving the gate for each of the aforesaid regenerative thermal chamber units through a reciprocating cycle which includes forward movement through a said first position, said second position and said third position; and, (e) inlet ducts connected to said inlet openings and outlet ducts connected to said outlet openings.

11. The thermal oxidizer apparatus of claim 10 wherein, each of said regenerative thermal chamber units has a thermal reaction section and a heat recovery section.

12. The thermal oxidizer apparatus of claim 10 which further includes means for controlling the movement of each of said gates relative to one another so as to coordinate gate movement to create equal volumes of inlet gases and outlet gases during operation of said apparatus.

13. The thermal oxidizer apparatus of claim 12 wherein, said means for controlling said movement is electro-mechanical.

14. The thermal oxidizer apparatus of claim 12 wherein, said means for controlling said movement includes preprogrammed computer control.

15. The thermal oxidizer apparatus of claim 12 wherein, said means for controlling said movement is hydraulic.

16. The thermal oxidizer apparatus of claim 12 wherein, said means for controlling said movement is pneumatic.

17. The thermal oxidizer apparatus of claim 10 wherein, said means for moving the gates includes an electric motor driven system.

18. The thermal oxidizer apparatus of claim 10 wherein, said means includes motor driven gear drives.

19. A method for purifying gases by thermal oxidation incineration and for exchange of heat between inleting and outleting gases, which comprises:

(a) feeding gases to be purified by incineration to a thermal oxidizer apparatus with an oxidizer having at least a first regenerative thermal chamber unit, a second such unit and a third such unit, each of the aforesaid regenerative thermal chamber units having at least an inlet opening and an outlet opening located on a single base surface and being spaced apart a distance equal to or more than the width of a gate orifice described below each of the aforesaid regenerative thermal chamber units further having a gate with at least one gate orifice and being movably located in a linear fashion against said base surface so as to have a first position, a second position and a third position against said base surface, said first position being with direct alignment of said gate orifice with the inlet opening, said second position being with said gate orifice located between the inlet opening and the outlet opening, and said third position being with direct alignment of said gate orifice with the outlet opening; and having means for moving the gate for each of the aforesaid regenerative thermal chamber units through a cycle which includes forward movement through a said first position, said second position and said third position and reverse movement back through said second and first positions; and having inlet ducts connected to said inlet openings and outlet ducts connected to said outlet openings;

(b) controlling the movement of each of said gates so that at least one chamber unit has an inlet opening in the open position and at least one other chamber unit has an outlet opening in the open position;

(c) moving said gases to be purified through the chamber unit with the open inlet opening and thermally oxidizing said gases in said chamber unit;

(d) moving said gases from said chamber unit with the open inlet opening to the chamber unit with the open outlet opening and absorbing heat for recovery within said chamber unit from said gases; and, (e) exhausting said gases from said chamber unit.

20. The method of claim 19 wherein, the aforesaid gates are moved relative to one another so as to coordinate gate movement to create equal volumes of inlet gases and outlet gases during operation of said apparatus and so as to periodically open inlet openings with outlet openings closed, close both inlet and outlet openings and close said inlet openings and open said outlet openings for each chamber unit with such movement being sequential, periodic and out of phase with respect to at least two other chamber units for each said chamber unit.

21. The method of claim 19 wherein, said movement of gates is accomplished electro-mechanically.

22. The method of claim 19 wherein, said movement of gates is by a preprogrammed computer.

23. The method of claim 19 further including periodically purging gases for recycling of unincinerated gases from chamber units holding such gases at some time during the gate movement cycles.

24. The method of claim 23 wherein, said purging is computer controlled by the timely opening and closing of valves within purged lines.

* * * * *